US005823244A

United States Patent [19]

Hsieh

[11] Patent Number: 5,823,244

[45] Date of Patent: Oct. 20, 1998

[54] METHOD FOR INTEGRALLY FORMING GOLF CLUB HEADS

[76] Inventor: Wen Liang Hsieh, No. 12, Min-Chuan Street, Mi-Ching Village, Mi-To Hsiang, Kaohsiung Hsien, Taiwan

[21] Appl. No.: 887,120

[22] Filed: Jul. 2, 1997

[51] Int. Cl.[6] ..... B22D 19/00

[52] U.S. Cl. ..... 164/112; 164/98; 164/332

[58] Field of Search ..... 164/98, 112, 332

[56] References Cited

U.S. PATENT DOCUMENTS

| | | | |
|---|---|---|---|
| 4,558,505 | 12/1985 | Moore | 164/112 X |
| 5,398,746 | 3/1995 | Igarashi | 164/98 |
| 5,595,234 | 1/1997 | Beck | 164/112 X |

FOREIGN PATENT DOCUMENTS

| | | | |
|---|---|---|---|
| 4-37465 | 2/1992 | Japan | 164/98 |

*Primary Examiner*—J. Reed Batten, Jr.
*Attorney, Agent, or Firm*—Bacon & Thomas

[57] ABSTRACT

A male mold having a first cavity and a female mold with a second cavity are provided, the first cavity and the second cavity having a contour complimentary to that of a golf club head, a bottom wall defining one of the first cavity and the second cavity having a recess defined therein. An insert piece is inserted into the recess. Molten metal is poured into the first cavity and the second cavity to form the golf club head in which the insert piece is integrally formed with the golf club head.

7 Claims, 5 Drawing Sheets

METHOD FOR INTEGRALLY FORMING GOLF CLUB HEADS

BACKGROUND OF THE INVENTION

1. Field of the Invention

The present invention relates to a method for integrally forming golf club heads.

2. Description of the Related Art

FIGS. 8 to 10 of the drawings illustrate a typical prior art golf club head which includes a recess 91 defined in a side thereof for fittingly receiving a hitting face plate 92. The recess 91 is trapezoidal in section in which a length thereof tapers from an inner end toward an outer end thereof, as shown in FIG. 9. However, the face plate 92 cannot fill the corners of the recess 91 such that a gap 93 is defined in each corner (FIG. 10). After a term of use, the face plate 92 might be loosened and thus disengaged from the recess 91 which, in turn, might adversely affect the hitting accuracy and sometimes even cause accidents.

Therefore, there has been a long and unfulfilled need for an improved golf club head structure which mitigates and/or obviates the above problems.

SUMMARY OF THE INVENTION

The present invention provides a method for manufacturing a golf club head which comprises the steps of:

(a) providing a male mold having a first cavity and a female mold with a second cavity, the first cavity and the second cavity having a contour complimentary to that of a golf club head, a bottom wall defining one of the first cavity and the second cavity having a recess defined therein, (b) inserting an insert piece into the recess, and (c) pouring molten metal into the first cavity and the second cavity to form the golf club head in which the insert piece is integrally formed with the golf club head.

The insert piece, preferably made of, copper, may be one of a face plate, decorative plate, and balance plate of the golf club head. The insert piece is arcuate before received in the recess, and is flattened when received in the recess so as to extend longitudinally to bear against two ends of the recess. The insert piece may be flush with the club head, embedded in the club head, or protrude beyond the club head.

Other objects, advantages, and novel features of the invention will become more apparent from the following detailed description when taken in conjunction with the accompanying drawings.

DESCRIPTION OF THE PREFERRED EMBODIMENTS

Figure 1:
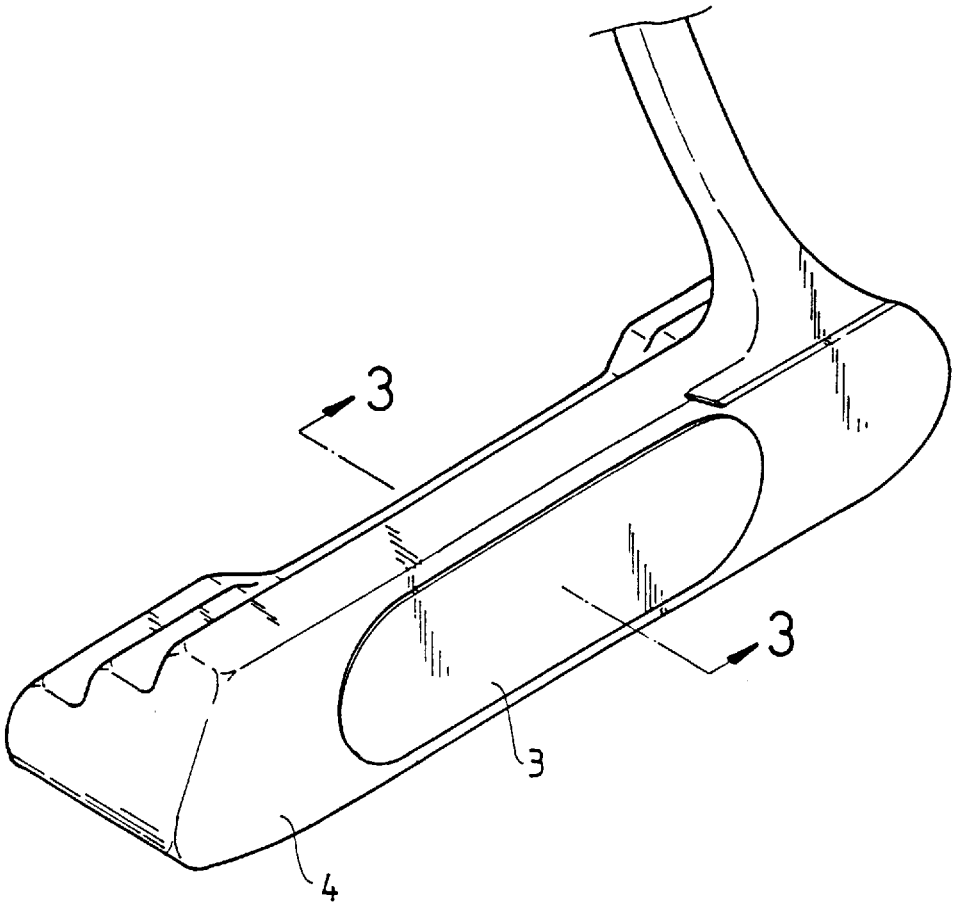
FIG. 1 is a perspective view of a golf club head in accordance with the present invention.
Figure 2:
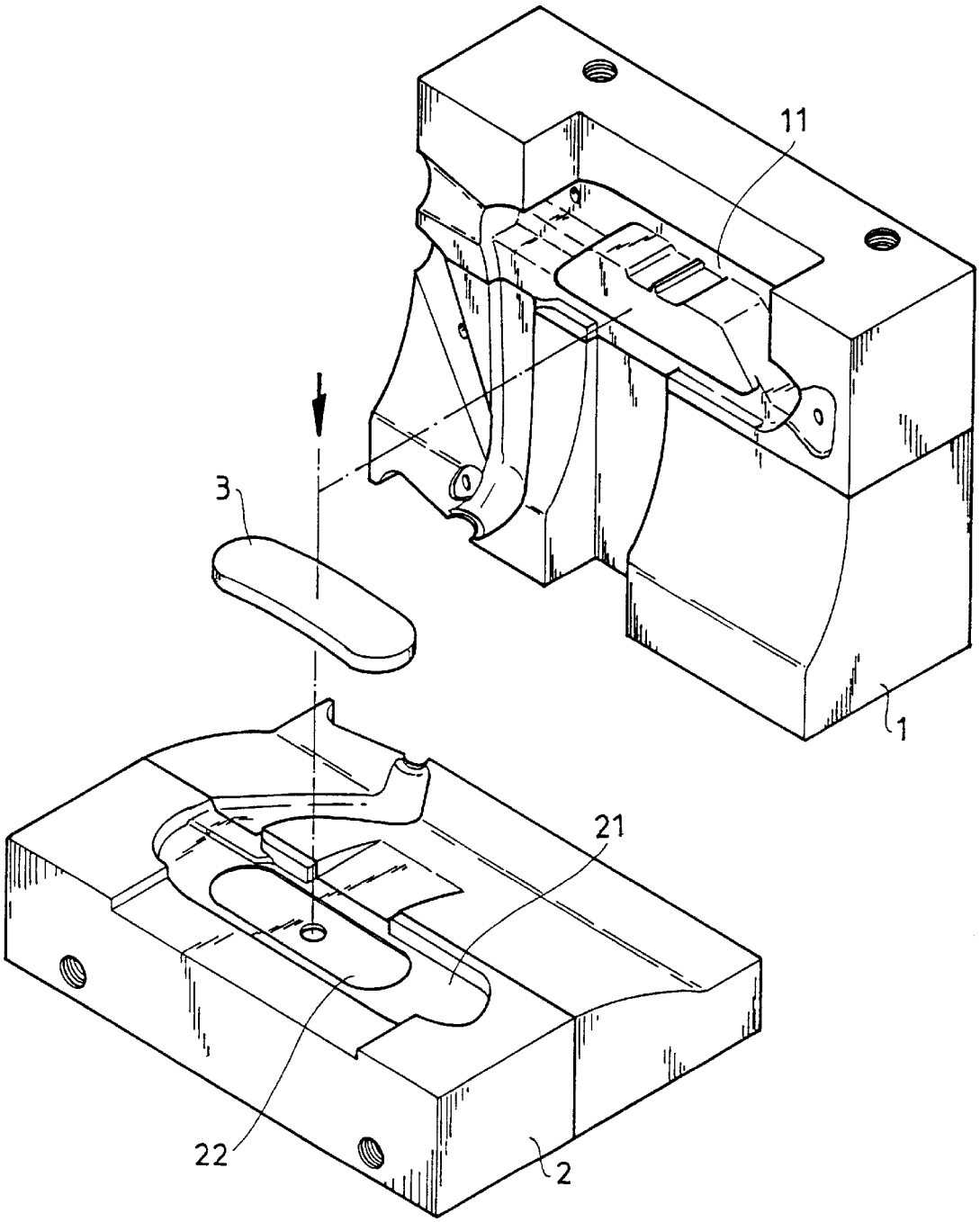
FIG. 2 is an exploded perspective view of a male mold and a female mold for manufacturing the golf club head in accordance with the present invention.

Referring to FIGS. 1 to 7 and initially to FIGS. 1 and 2, a male mold 1 and a female mold 2 are used to manufacture a golf club head 4 in accordance with the present invention. The male mold 1 includes a first cavity 11 defined therein while the female mold 2 includes a second cavity 21 therein, and molten metal, e.g., alloy of zinc, titanium, and aluminum may be poured into the cavities 11 and 21 to form the required integral golf club head. The first cavity 11 and the second cavity 21 have a contour complimentary to that of a golf club head. It is noted that a bottom wall defining one of the cavities, e.g., the second cavity 21, includes a recess 22 defined therein for receiving an insert piece 3.

The insert piece 3 may be made of metal and can be used as the face plate, decorative plate, or balance weight of the club head 4. The insert piece 3 is inserted into the recess 22, and, in order to provide a better positioning effect, the insert piece 3 may be arcuate at first and then flattened (e.g., by hammering) when received in the recess 22 such that two ends of the insert piece 3 may respectively, securely bear against two ends of the recess 22. In addition, the insert piece 3 and the club head 4 can be easily removed from the molds 1 and 2 after formation.

Figure 3:
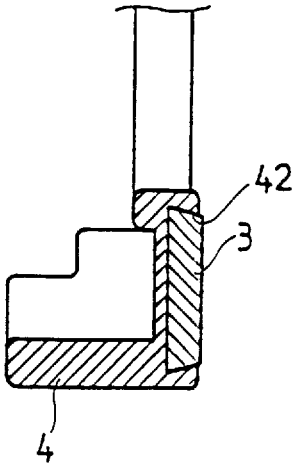
FIG. 3 is a sectional view taken along line 3—3 in FIG. 1.
Figure 4:
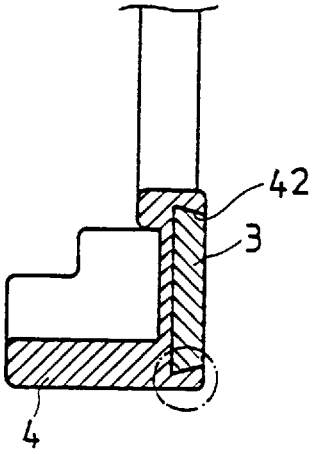
FIG. 4 is a sectional view similar to FIG. 3, in which the face plate is further processed.
Figure 5:
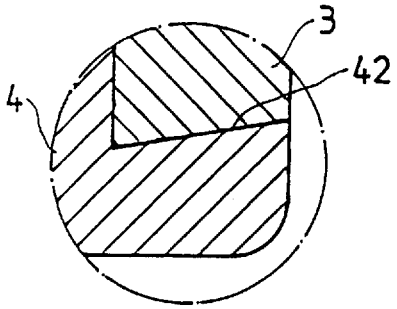
FIG. 5 is an enlarged view of a circle in FIG. 4.
Figure 6:
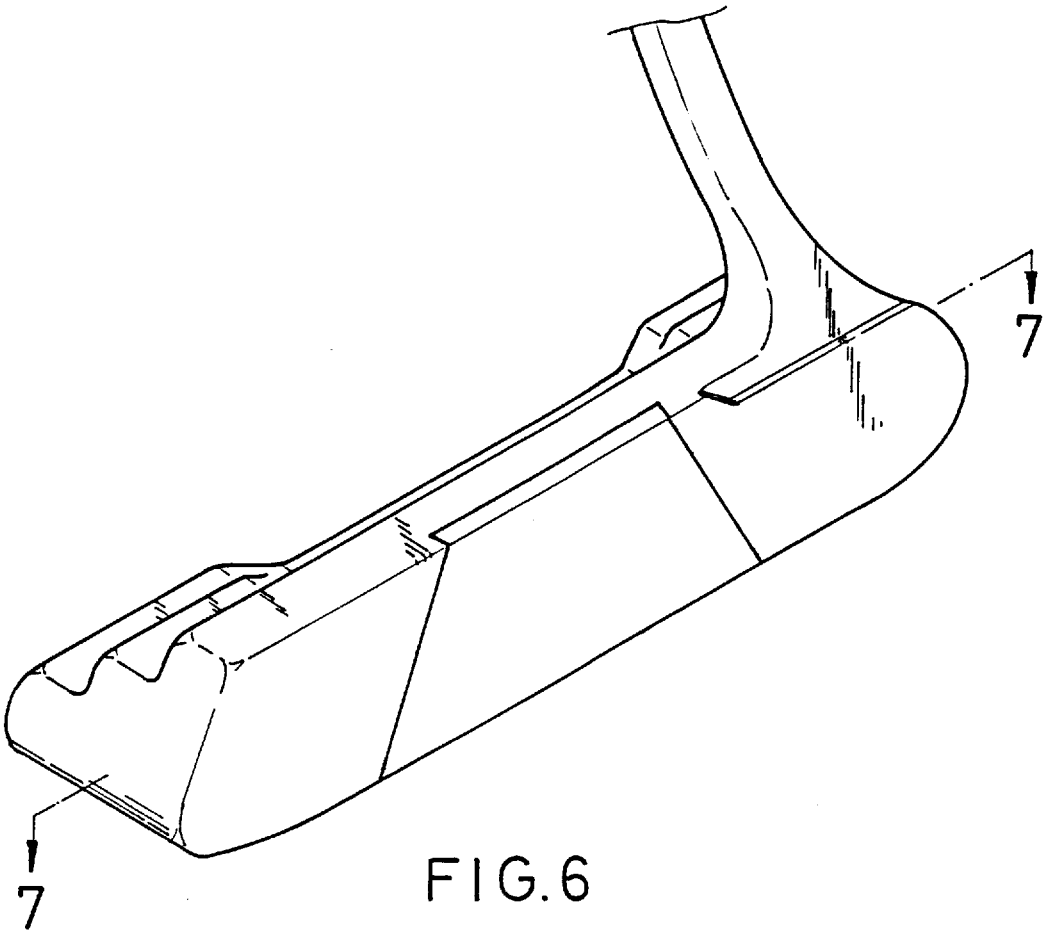
FIG. 6 is a perspective view illustrating a modified embodiment of a golf club structure in accordance with the present invention.
Figure 7:
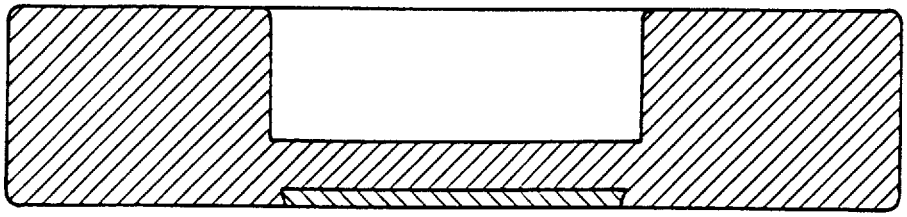
FIG. 7 is a sectional view taken along line 7—7 in FIG. 6.
Figure 8:
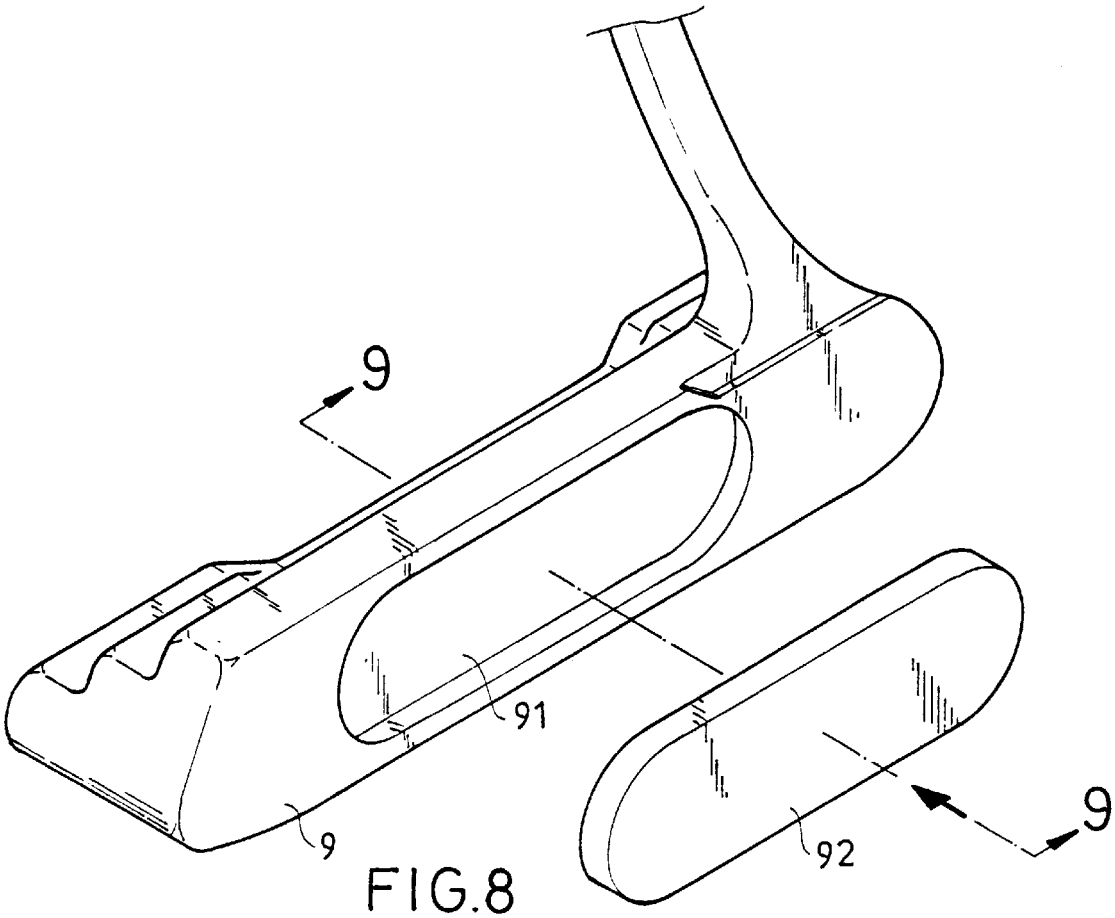
FIG.8 PRIOR ART
FIG. 8 is a perspective view, partly exploded, of a golf club head according to prior art.
Figure 9:
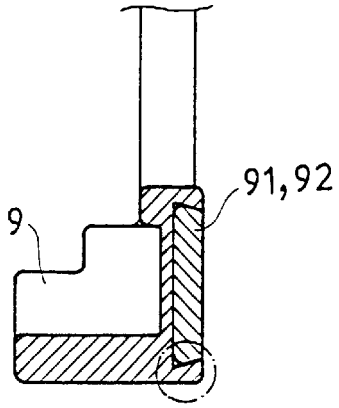
FIG.9 PRIOR ART
FIG. 9 is a sectional view taken along line 9—9 in FIG. 8.
Figure 10:
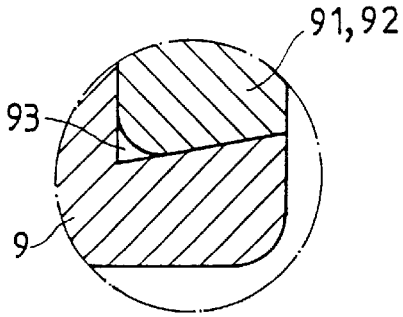
FIG.10 PRIOR ART
FIG. 10 is an enlarged view of a circle in FIG. 9.

FIG. 1 illustrates a golf club head formed in the molds 1 and 2, in which the insert piece 3, which is now used as a face plate, includes a periphery fittingly received in a second recess 42 of the club head 4 without any gaps left therebetween (FIGS. 3 to 5). The face plate 3, preferably made of copper, may be processed so as to be flush with the club head 4 (FIG. 4). Alternatively, the face plate 3 may protrude beyond the club head 4 (FIG. 3) or completely embedded in the club head. FIGS. 6 and 7 illustrate a modified embodiment of the present invention, in which the face plate and the second recess may have other different shapes without affecting the integrality between the club head and the face plate.

According to the above description, it is appreciated that a golf club head so formed may have a reliable secure engagement between the face plate and the club head.

Although the invention has been explained in relation to its preferred embodiment, it is to be understood that many other possible modifications and variations can be made without departing from the spirit and scope of the invention as hereinafter claimed.

What is claimed is:

1. A method for manufacturing a golf club head, comprising the steps of:

(a) providing a male mold having a first cavity and a female mold with a second cavity, the first cavity and the second cavity having a contour complimentary to that of a golf club head, a bottom wall defining one of the first cavity and the second cavity having a recess defined therein, (b) inserting an insert piece into the recess, and (c) pouring molten metal into the first cavity and the second cavity to form the golf club head in which the insert piece is integrally formed with the golf club head.

2. The method according to claim 1, wherein the insert piece is one of a face plate, decorative plate, and balance plate of the golf club head.

3. The method according to claim 1, wherein the insert piece is made of copper.

4. The method according to claim 1, wherein the insert piece is arcuate before received in the recess, and is flattened when received in the recess so as to extend longitudinally to bear against two ends of the recess.

5. The method according to claim 1, wherein the insert piece is flush with the club head.

6. The method according to claim 1, wherein the insert piece is embedded in the club head.

7. The method according to claim 1, wherein the insert piece protrudes beyond the club head.

* * * * *